US006359569B2

(12) United States Patent
Beck et al.

(10) Patent No.: US 6,359,569 B2
(45) Date of Patent: Mar. 19, 2002

(54) METHODS AND ASSOCIATED APPARATUS FOR DOWNHOLE DATA RETRIEVAL, MONITORING AND TOOL ACTUATION

(75) Inventors: Harold Kent Beck, Copper Canyon; Clark E. Robison, Tomball; Arthur Isadore Burke, Plano, all of TX (US); Ian Collin Phillips, Aberdeen (GB); Elbert Juan Smith, Garland; Tance Jackson, Plano, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/746,185

(22) Filed: Dec. 20, 2000

Related U.S. Application Data

(62) Division of application No. 09/390,961, filed on Sep. 7, 1999.

(51) Int. Cl.[7] ..... G01V 3/00

(52) U.S. Cl. ..... 340/856.3; 340/453.1; 340/854.6; 340/854.8; 175/40; 166/250.01

(58) Field of Search ..... 166/250.01; 73/61.75; 340/853.1, 573.4, 854.3, 854.6, 854.8, 856.3; 175/40

(56) References Cited

U.S. PATENT DOCUMENTS

| | | | | |
|---|---|---|---|---|
| 4,499,955 A | | 2/1985 | Campbell et al. | |
| 4,570,718 A | | 2/1986 | Adams, Jr. | |
| 4,617,960 A | | 10/1986 | More | |
| 4,656,463 A | * | 4/1987 | Anders | 340/572.2 |
| 4,698,631 A | * | 10/1987 | Kelly | 340/853 |
| 4,790,380 A | | 12/1988 | Irelaud et al. | |
| 5,008,664 A | | 4/1991 | More et al. | |
| 5,188,183 A | | 2/1993 | Hopmann et al. | |
| 5,202,680 A | * | 4/1993 | Savage | 340/853.1 |
| 5,257,530 A | | 11/1993 | Beattie et al. | |
| 5,348,492 A | | 9/1994 | Sonnet | |
| 5,477,921 A | | 12/1995 | Tollefsen | |
| 5,531,270 A | | 7/1996 | Fletcher et al. | |
| 5,706,896 A | | 1/1998 | Tubel et al. | |
| 5,960,883 A | | 10/1999 | Tubel et al. | |
| 5,971,072 A | | 10/1999 | Huber et al. | |
| 6,041,864 A | | 3/2000 | Patel et al. | |
| 6,105,690 A | | 8/2000 | Bigliu, Jr. et al. | |
| 6,151,961 A | | 11/2000 | Huber et al. | |

FOREIGN PATENT DOCUMENTS

| | | |
|---|---|---|
| EP | 0773345 A1 | 5/1997 |
| EP | 0882871 A2 | 12/1998 |
| GB | 2104665 A | 3/1983 |
| GB | 2323109 A | 9/1998 |

OTHER PUBLICATIONS

International Search Report Application No.: PCT/US00/23722.

* cited by examiner

*Primary Examiner*—Michael Horabik
*Assistant Examiner*—Albert K. Wong
(74) *Attorney, Agent, or Firm*—William M. Imwalle; Marlin R. Smith

(57) ABSTRACT

A system of downhole communication and control is provided in methods and associated apparatus for data retrieval, monitoring and tool actuation. In a described embodiment, an item of equipment installed in a tubular string has a first communication device associated therewith. A tool conveyed into the tubular string has a second communication device therein. Communication is established between the first and second devices. Such communication may be utilized to control operation of the tool, retrieve status information regarding the item of equipment, supply power to the first device and/or identify the item of equipment to the tool.

24 Claims, 7 Drawing Sheets

METHODS AND ASSOCIATED APPARATUS FOR DOWNHOLE DATA RETRIEVAL, MONITORING AND TOOL ACTUATION

This is a division, of pending application Ser. No. 09/390,961, filed Sep. 7, 1999, such prior application being incorporated by reference herein in its entirety.

BACKGROUND OF THE INVENTION

The present invention relates generally to operations performed in conjunction with a subterranean well and, in an embodiment described herein, more particularly provides a method and apparatus for downhole retrieval of data, monitoring and tool actuation.

It is usually the case that a tubular string is installed in a subterranean well with one or more items of equipment interconnected in the tubular string. Thereafter, a tool conveyed into the tubular string may be positioned relative to the item of equipment, engaged with the item of equipment and/or utilized to actuate the item of equipment, etc.

In the past, various mechanisms and methods have been utilized for positioning a tool relative to an item of equipment in a tubular string, for engaging the tool with the item of equipment and for utilizing the tool to actuate the item of equipment. For example, where the item of equipment is a sliding sleeve-type valve, a shifting tool is typically conveyed on wireline, slickline or coiled tubing into the valve and engaged with the sliding sleeve. An operator is aware that the shifting tool is properly positioned relative to the valve due to the engagement therebetween, as confirmed by the application of force to the shifting tool. The shifting tool may be configured so that it operatively engages only the desired sliding sleeve, out of multiple items of equipment installed in the tubular string, by equipping the shifting tool with a particular set of keys or lugs designed to engage only a particular profile formed in the desired sliding sleeve.

Unfortunately, it is often the case that the operator is not able to positively determine whether the shifting tool is properly engaged with the desired sliding sleeve, such as when the well is highly deviated. Additionally, the operator may not accurately know information which would aid in performance of the task of shifting the sleeve. For example, the operator might not know that an excessive pressure differential exists across the sleeve, or the operator might attempt to shift the sleeve to its fully open position not knowing that this should not be done with an excessive pressure differential across the sleeve. Thus, it may be clearly seen that improved methods of positioning, engaging and actuating tools are needed.

Many operations in wells would be enhanced if communication were permitted between an item of equipment installed in a tubular string and a tool conveyed into the string. For example, if a valve was able to communicate its identity to a shifting tool, an accurate determination could be made as to whether the tool should be engaged with the valve. If a valve was able to communicate to the tool data indicative of pressure applied to a closure member of the valve, such as a sliding sleeve, a determination could be made as to whether the tool should displace the closure member, or to what position the closure member should be displaced.

Improved communication methods would also permit monitoring of items of equipment in a well. In one application, a tool conveyed into a tubular string could collect data relating to the status of various items of equipment installed in the tubular string. It would be desirable, for example, to be able to monitor the status of a packer seal element in order to determine its remaining useful service life, or to be able to monitor the strain, pressure, etc. applied to a portion of the tubular string, etc.

Therefore, from the foregoing, it may be seen that it would be highly advantageous to provide improved methods and apparatus for downhole data retrieval, monitoring and tool actuation.

SUMMARY OF THE INVENTION

In carrying out the principles of the present invention, in accordance with an embodiment thereof, a system for facilitating downhole communication between an item of equipment installed in a tubular string and a tool conveyed into the tubular string is provided. Associated methods of facilitating such downhole communication are also provided, as well as applications in which the downhole communication is utilized for data retrieval, monitoring and tool actuation.

In one aspect of the present invention, the downhole communication system includes a first communication device associated with the item of equipment and a second communication device included in the tool. Communication may be established between the devices when the device in the tool is brought into sufficiently close proximity to the device associated with the item of equipment.

In another aspect of the present invention, the tool supplies power to the first device. Such provision of power by the tool may enable the first device to communicate with the second device. In this manner, the first device does not need to be continuously powered. The first device may, however, be maintained in a dormant state and then activated to an active state by the tool.

In yet another aspect of the present invention, the communication between the first and second devices may be by any of a variety of means. For example, electromagnetic waves, inductive coupling, pressure pulses, direct electrical contact, etc. may be used. The communication means may also be the means by which power is supplied to the first device.

In still another aspect of the present invention, communication between the devices may be used to control operation of the tool. For example, where the item of equipment is a valve and the tool is a shifting tool for displacing a closure member of the valve, communication between the first and second devices may be used to determine whether an excessive pressure differential exists across the closure member. This determination may then be utilized to control the displacement of the closure member by the tool. As another example, the tool may not be permitted to engage the item of equipment until the communication between the devices indicates that the tool is appropriately positioned relative to the item of equipment.

In yet another aspect of the present invention, communication between the devices may be used to monitor a status of the item of equipment. For example, the first device may be connected to a sensor, such as a pressure sensor, a strain gauge, a hardness sensor, a position sensor, etc., and may transmit data regarding the status to the second device.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
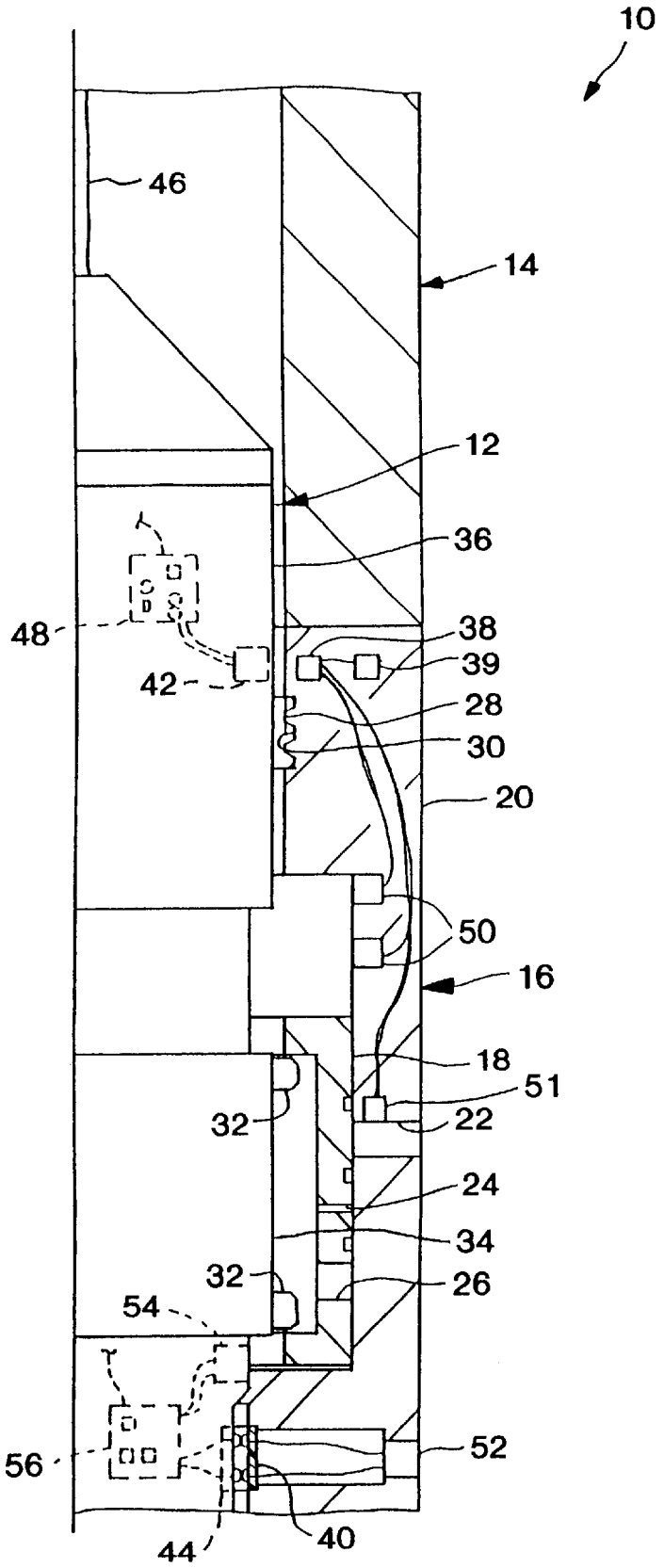
FIG. 1 is a schematic partially cross-sectional view of a first apparatus and method embodying principles of the present invention.

Representatively and schematically illustrated in FIG. 1 is a method 10 which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

In the method 10, a service tool 12 is conveyed into a tubular string 14 and engaged with an item of equipment or valve 16 interconnected in the string. As representatively illustrated in FIG. 1, the valve 16 is a sliding sleeve-type valve and the tool 12 is utilized to displace a closure member or sleeve 18 of the valve relative to a housing 20 of the valve to thereby permit or prevent fluid flow through one or more openings 22 formed through a sidewall of the housing. However, it is to be clearly understood that a method incorporating principles of the present invention may be performed with other items of equipment and other types of valves, and with other types of service tools.

The sleeve 18 of the representatively illustrated valve 16 has three positions relative to the housing 20. In the closed position of the sleeve 18 as depicted in FIG. 1, the sleeve completely prevents fluid flow through the opening 22. If the sleeve 18 is displaced upwardly until a relatively small diameter opening 24 formed through a sidewall of the sleeve is aligned with the opening 22 in the housing 20, the sleeve is in an equalizing position in which limited fluid flow is permitted through the opening 22. The equalizing position of the sleeve 18 is typically utilized in this type of valve when there is an excessive pressure differential across the sleeve and it is desired to reduce this pressure differential without eroding or damaging seals resisting the pressure differential. If the sleeve 18 is displaced further upwardly until another opening 26 formed through the sleeve sidewall is aligned with the opening 22 in the housing 20, the sleeve is in an open position in which relatively unrestricted fluid flow is permitted through the opening 22. Of course, it is not necessary in keeping with the principles of the present invention for a valve or other item of equipment to have the positions representatively described above and depicted in FIG. 1.

The tool 12 is utilized to displace the sleeve 18 between the closed, equalizing and open positions as needed to control fluid flow through the opening 22. In order to secure the tool 12 relative to the housing 20, the tool is provided with one or more engagement members, lugs, dogs or keys 28 configured for cooperative engagement with a profile 30 internally formed in the housing. Other means of securing the tool 12 relative to the valve 16, other types of engagement members and other types of profiles may be utilized in the method 10, without departing from the principles of the present invention.

The tool 12 also includes engagement members or dogs 32 for engaging the sleeve 18. The dogs 32 permit application of an upwardly or downwardly directed force from the tool 12 to the sleeve 18 for displacement of the sleeve upwardly or downwardly relative to the housing 20. Of course, if in an alternate embodiment a closure member of a valve is displaced radially, rotationally, laterally or otherwise, corresponding changes to the tool 12 may be made in keeping with the principles of the present invention. Additionally, differently configured, numbered, arranged, etc., engagement members may be used to provide engagement between the tool 12 and the sleeve 18 and/or housing 20.

The dogs 32 extend outwardly from a housing 34 which is attached to an actuator 36 of the tool 12. As representatively described herein, the actuator 36 is a linear actuator, since the sleeve 18 is linearly displaced between its positions relative to the housing 20, however, it is to be clearly understood that other types of actuators may be utilized, without departing from the principles of the present invention. An acceptable actuator which may be used for the actuator 36 is the DPU (Downhole Power Unit) available from Halliburton Energy Services, Inc.

The DPU is especially adapted for conveyance by slickline or coiled tubing, since it is battery-powered. A slickline 46 is depicted in FIG. 1 as the means used to convey the tool 12 in the string 14. It should be noted, however, that otherwise powered actuators and other means of conveying a tool within a string may be utilized, without departing from the principles of the present invention.

The valve 16 includes communication devices 38, 40 which permit communication between the valve and respective communication devices 42, 44 of the tool 12. The communication devices 38, 40, 42, 44 may serve many purposes in the interaction of the tool 12 with the valve 16, and many of these are described below. However, the descriptions of specific purposes for the communication devices 38, 40, 42, 44 in the representatively illustrated method 10 are not to be taken as limiting the variety of uses for communication devices in a method incorporating principles of the present invention.

The device 38 may be supplied with power by a battery or other power source 39. The power source 39 may be included in the valve 16, or it may be remote therefrom. It is to be clearly understood that any means of supplying power to the device 38 may be utilized, without departing from the principles of the present invention. The power source 39 may also supply power to sensors, etc. associated with the device 38.

The device 38 may communicate to the device 42 the identity of the valve 16 (e.g., a digital address of the valve), so that a determination may be made as to whether the tool 12 is positioned relative to the proper item of equipment in the string 14. The string 14 may include multiple items of equipment, and this communication between the devices 38, 42 may be used to select the valve 16 from among the multiple items of equipment for operation of the tool 12 therewith. For example, the device 38 may continuously transmit a signal indicative of the identity of the valve 16 so that, as the tool 12 is conveyed through the string 14, the device 42 will receive the signal when the devices 38, 42 are in sufficiently close proximity to each other.

As another example, the device 38 may not transmit a signal until the device 42 polls the device 38 by transmitting a signal as the tool 12 is conveyed through the string 14. The tool 12 may be programmed to transmit a signal to which only the device 38, out of multiple such devices of respective other items of equipment installed in the string 14, will respond. Such programming may be accomplished, for example, by utilizing an electronic circuit 48 connected to the device 42 in the tool 12 or, if the tool 12 is in communication with a remote location, for example, via wireline or other data transmission means, the programming may be accomplished remote from the tool. The above-described methods of identifying an item of equipment to a service tool, and of selecting from among multiple items of equipment installed in a tubular string for operation of a tool therewith, may be utilized with any of the methods described herein.

Transmission of a signal from the device 42 to the device 38 may activate the device 38 from a dormant state, in which the device 38 consumes very little power, to an active state, in which more power is consumed by the device 38 as it communicates with the device 42. Such activation of the device 38 may permit the device 38 to communicate with the device 42.

As another alternative, the tool 12 may supply power to operate the device 38. Thus, the device 38 may not communicate with the device 42 until the tool 12 is in sufficiently close proximity to the valve 16, or is in an operative position relative to the valve. Methods of supplying power from the tool 12 to operate the device 38 are described below. However, it is to be clearly understood that other methods may be utilized, without departing from the principles of the present invention.

Another purpose which may be served by the communication between the devices 42, 38 is to provide an indication that the tool 12 is operatively positioned, or at least within a predetermined distance of an operative position, relative to the valve 16. For example, communication between the devices 38, 42 may indicate that the engagement member 28 is aligned with the profile 30. The tool 12 may be prevented from extending the engagement member 28 outwardly into engagement with the profile 30 until the communication between the devices 38, 42 indicates such alignment. This indication may be transmitted by the tool 12 to a remote location, for example, so that an operator may confirm that the tool 12 has operatively engaged the valve 16.

Yet another purpose which may be served by the communication between the devices 38, 42 is to indicate the position of the sleeve 18 relative to the housing 20. As representatively illustrated in FIG. 1, one or more position sensors 50, such as hall effect devices or a displacement transducer, etc., may be connected to the device 38, so that the device may transmit data indicative of the sleeve 18 position to the device 42. This indication may then be transmitted by the tool 12 to a remote location, for example, so that an operator may confirm the sleeve 18 position.

Note that one or more of the sensors 50 may be any type of sensor. For example, one of the sensors 50 may be a pressure or temperature sensor. Use of one of the sensors 50 as a pressure indicator may be useful in determining pressure applied to, or a pressure differential across, the sleeve 18.

Another sensor 51 is positioned proximate at least one of the openings 22, and may be in contact with fluid flowing through the opening. The sensor 51 is connected to the device 38 for transmission of data from the sensor to the device. The sensor 51 may be a resistivity, capacitance, inductance and/or particle sensor for detecting these properties of fluid flowing through the opening 22. For example, the sensor 51 may be utilized to determine a percentage of water in the fluid flowing through the opening 22, to determine the number and/or size of particles flowing through the opening 22, etc.

The devices 40, 44 communicate by direct electrical contact therebetween. As depicted in FIG. 1, the device 40 is connected to a pressure sensor 52 exposed to fluid pressure on the exterior of the housing 20. In conjunction with another pressure sensor, such as one of the sensors 50 or another pressure sensor 54, exposed to fluid pressure in the interior of the housing 20, the pressure differential across the sleeve 18 may be readily determined. Such determination may be made by an electronic circuit 56 of the tool 12, transmitted from the tool to a remote location and/or the determination may be made at the remote location from a transmission of the interior and exterior pressure indications.

As with the devices 38, 42 described above, communication between the devices 40, 44 may be used for many purposes, in addition to that of sensor data communication. For example, communication between the devices 40, 44 may be used to indicate that the tool 12 is operatively positioned relative to the valve 16. Since the representatively illustrated devices 40, 44 communicate by direct electrical contact, such communication between the devices indicates at least that the devices are aligned with each other. This indication may be transmitted by the tool 12 to a remote location. This indication may also be used to control extension of the dogs 32 outwardly from the housing 34 into engagement with the sleeve 18 by the tool 12 in a manner similar to that described above for control of extension of the keys 28. An indication that the keys 28 and/or dogs 32 have operatively engaged the respective housing 20 and/or sleeve 18 may also be transmitted by the tool 12 to a remote location.

As another example, the circuit 36, or another circuit at a remote location, may be programmed to control operation of the tool 12 based at least in part on data communicated between the devices 40, 44. The circuit 56 may be connected to the actuator 36 and may be programmed to prevent the actuator from displacing the sleeve 18 to the open position if the sensors 52, 54 indicate that the pressure differential across the sleeve is outside an acceptable range, e.g., if the pressure differential is excessive. The circuit 56 may further be programmed to permit the actuator 36 to displace the sleeve 18 to the equalizing position, but not to the open position, if the pressure differential across the sleeve is excessive.

Thus, it will be readily appreciated that the method 10 provides for convenient operation of the tool 12 in conjunction with the valve 16, with reduced possibility of human error involved therewith. An operator may convey the tool 12 into the string 14, the tool and the valve 16 may communicate via the devices 38, 42 and/or 40, 44 to indicate the identity of the valve and/or to select the valve from among multiple items of equipment installed in the string, and such communication may be used to indicate that the tool is operatively positioned relative to the valve, to control engagement of the tool with the valve, to indicate useful status information regarding the valve, such as the position of the sleeve 18, pressure applied to the valve, pressure differential across the sleeve, etc., and to control operation of the tool. Due to the advances in the art provided by the method 10, when the tool 12 is utilized additionally to transmit information to a remote location, the operator is able to positively determine whether the valve 16 is the appropriate item of equipment intended to be engaged by the tool, whether the tool is operatively positioned relative to the valve, whether the tool has operatively engaged the valve, the position of the sleeve 18 both before and after it is displaced, if at all, by the tool, and the pressures and/or differential pressures, temperatures, etc. of concern.

Figure 2:
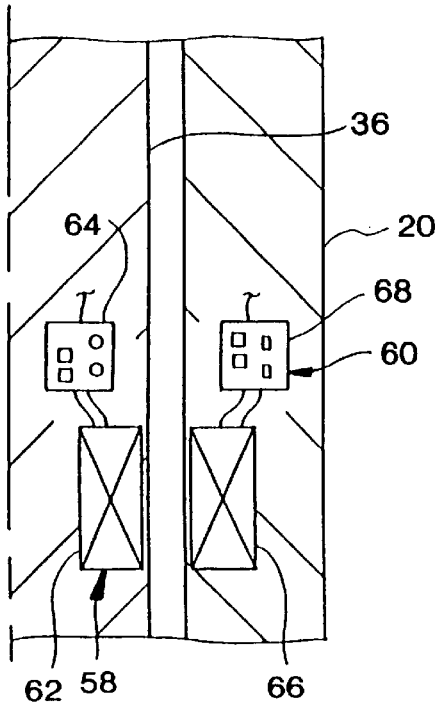
FIG. 2 is a schematic partially cross-sectional view of a second apparatus and method embodying principles of the present invention.

Referring additionally now to FIG. 2, alternate communication devices 58, 60 are representatively and schematically illustrated which may be used for the devices 38, 42 described above. As depicted in FIG. 2, the devices 58, 60 are shown installed in the actuator 36 and housing 20 of the method 10, but it is to be clearly understood that the devices 58, 60 may be used in other apparatus, other methods, and in substitution for other communication devices described herein, without departing from the principles of the present invention.

The devices 58, 60 communicate by inductive coupling therebetween. Power may also be supplied from the device 58 to the device 60 by such inductive coupling.

The device 58 includes an annular-shaped coil 62, which is connected to an electronic circuit 64. The circuit 64 causes electrical current to be flowed through the coil 62, and manipulates that current to cause the device 58 to transmit a signal to the device 60. Note that such signaling is via a magnetic field, and manipulations of the magnetic field, propagated by the coil 62 in response to the current flowed therethrough. The device 58 may also respond to a magnetic field, for example, propagated by the device 60, in which case the magnetic field would cause a current to flow through the coil 62 and be received by the circuit 64. Thus, the device 58 may serve as a transmitter or receiver.

The device 60 also includes a coil 66 and a circuit 68 connected to the coil. The device 60 may operate in a manner similar to that described above for the device 58, or it may operate differently. For example, the device 60 may only transmit signals, without being configured for receiving signals.

Figure 3:
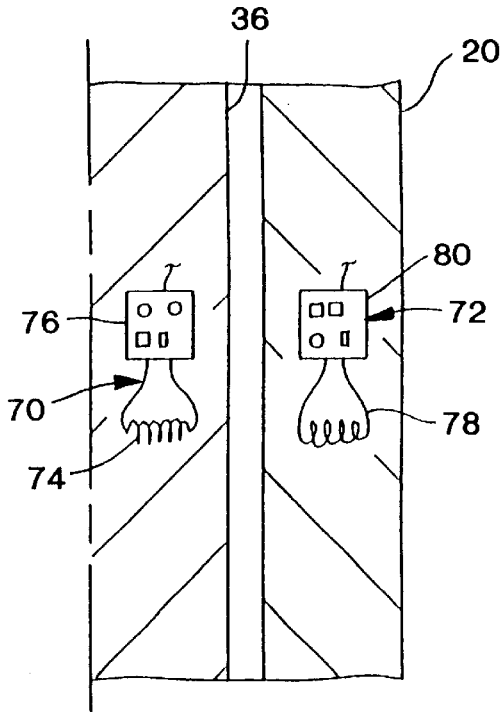
FIG. 3 is a schematic partially cross-sectional view of a third apparatus and method embodying principles of the present invention.

Referring additionally now to FIG. 3, further alternate communication devices 70, 72 are representatively and schematically illustrated which may be used for the devices 38, 42 described above. As depicted in FIG. 3, the devices 70, 72 are shown installed in the actuator 36 and housing 20 of the method 10, but it is to be clearly understood that the devices 70, 72 may be used in other apparatus, other methods, and in substitution for other communication devices described herein, without departing from the principles of the present invention.

The devices 70, 72 communicate by transmission of electromagnetic waves therebetween, preferably using radio frequency (RF) transmission. Power may also be supplied from the device 70 to the device 72 by such electromagnetic wave transmission.

The device 70 includes an antenna 74, which is connected to an electronic circuit 76. The circuit 76 causes electrical current to be flowed through the antenna 74, and manipulates that current to cause the device 70 to transmit a signal to the device 72. The device 70 may also respond to electromagnetic wave transmission from the device 72, in which case the device 70 may also serve as a receiver.

The device 72 also includes an antenna 78 and a circuit 80 connected to the antenna. The device 72 may operate in a manner similar to that described above for the device 70, or it may operate differently. For example, the device 72 may only transmit signals, without being configured for receiving signals.

Figure 4:
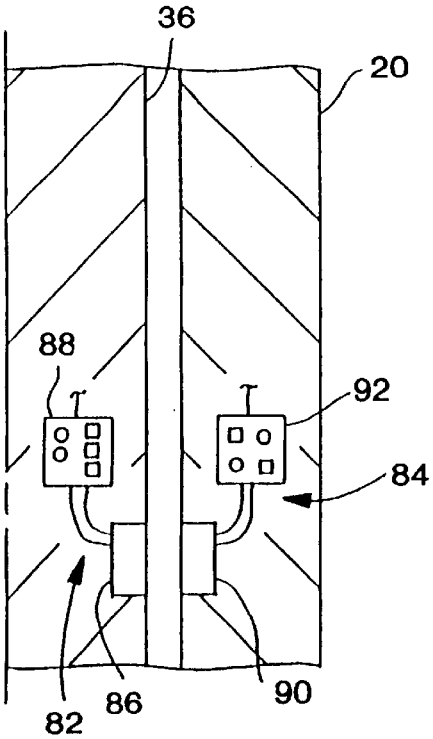
FIG. 4 is a schematic partially cross-sectional view of a fourth apparatus and method embodying principles of the present invention.

Referring additionally now to FIG. 4., still further alternate communication devices 82, 84 are representatively and schematically illustrated which may be used for the devices 38, 42 described above. As depicted in FIG. 4, the devices 82, 84 are shown installed in the actuator 36 and housing 20 of the method 10, but it is to be clearly understood that the devices 82, 84 may be used in other apparatus, other methods, and in substitution for other communication devices described herein, without departing from the principles of the present invention.

The devices 82, 84 communicate by transmission of pressure pulses therebetween, preferably using acoustic wave transmission. Power may also be supplied from the device 82 to the device 84 by such pressure pulses.

The device 82 includes at least one piezoelectric crystal 86, which is connected to an electronic circuit 88. The circuit 88 causes electrical current to be flowed through the crystal 86, and manipulates that current to cause the device 82 to transmit a signal to the device 84. The device 82 may also respond to pressure pulses transmitted from the device 84, in which case the device 82 may also serve as a receiver.

The device 84 also includes a piezoelectric crystal 90 and a circuit 92 connected to the crystal. The device 84 may operate in a manner similar to that described above for the device 82, or it may operate differently. For example, the device 84 may only transmit signals, without being configured for receiving signals.

Of course, it is well known that a piezoelectric crystal distorts when an electric current is applied thereto, and that distortion of a piezoelectric crystal may be used to generate an electric current therefrom. Thus, when the circuit 88 applies a current, or manipulates a current applied to, the crystal 86, the crystal distorts and causes a pressure pulse or pulses in fluid disposed between the actuator 36 and the housing 20. This pressure pulse or pulses, in turn, causes the crystal 90 to distort and thereby causes a current, or a manipulation of a current, to be flowed to the circuit 92. In a similar manner, the device 84 may transmit a signal to the device 82. Multiple ones of either or both of the crystals 86, 90 may be used, if desired, to increase the amplitude of the pressure pulses generated thereby, or to increase the amplitude of the signal generated when the pressure pulses are received.

Thus have been described several alternate means by which devices may communicate between an item of equipment interconnected in a tubular string and a tool conveyed into the string. It is to be clearly understood, however, that any type of communication device may be used for the communication devices described herein, and that the principles of the present invention are not to be considered as limited to the specifically described communication devices. Many other communication devices, and other types of communication devices, may be used in methods and apparatus incorporating principles of the present invention. For example, the crystal 90 could be a radioactivity producing device and the crystal 86 could be a radioactivity sensing device, the crystal 90 could be a magnet and the crystal 86 could be a hall effect device or a reed switch which closes in the presence of a magnetic field, etc. Furthermore, each of the communication devices described herein may have a power source incorporated therein, for example, a battery may be included in the each of the circuits 64, 68, 76, 80, 88, 92 described above.

Figure 5A:
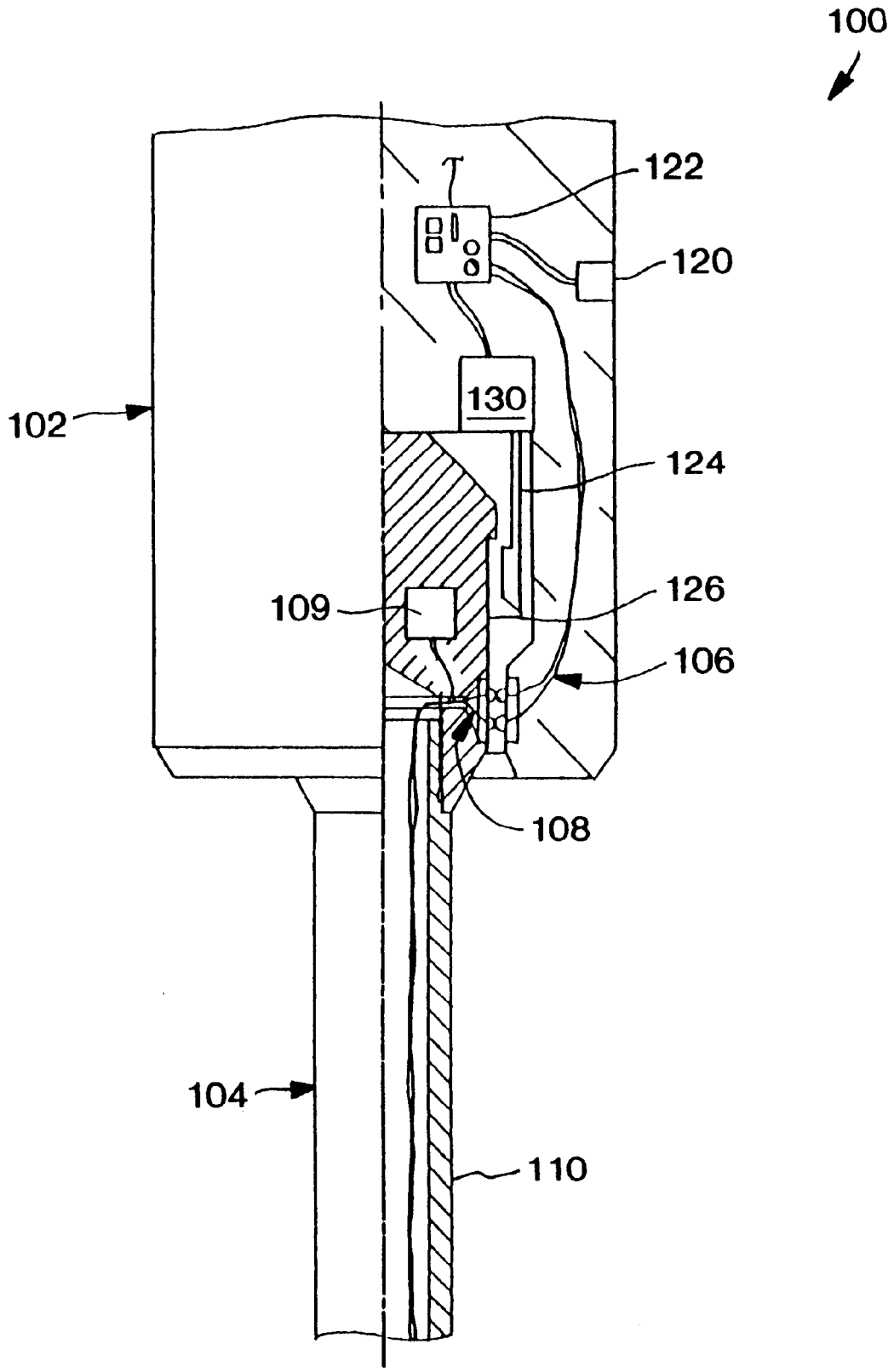
FIGS. 5A&B are schematic partially cross-sectional views of a fifth apparatus and method embodying principles of the present invention.

Referring additionally now to FIGS. 5A&B, a method 100 which embodies principles of the present invention is representatively and schematically illustrated. The method 100 is similar in many respects to the method 10 described above, in that a tool 102 is engaged with an item of equipment 104 installed in a tubular string and communication is established between a communication device 106 of the tool and a communication device 108 of the item of equipment. As depicted in FIGS. 5A&B, the item of equipment 104 is a plug system and the tool 102 is a retrieving tool, but it is to be understood that principles of the present invention may be incorporated in other tools and items of equipment.

The plug system 104 includes a closure member, pressure equalizing member or prong 110, which is sealingly received within a plug assembly 112. The plug assembly 112, in turn, is sealingly engaged within a nipple 114. The nipple 114 is of the type well known to those skilled in the art and which may be interconnected in a tubular string, but is shown apart from the tubular string for illustrative clarity.

The plug assembly 112 includes a lock mandrel 134, which releasably secures the plug assembly relative to the nipple 114, and a plug 136, which sealingly engages the nipple to block fluid flow therethrough. The plug system 104 may be considered to include the nipple 114, although the plug assembly 112 and prong 110 may be used to block fluid flow through other nipples or other tubular members and, thus, the plug assembly and prong may also be considered to comprise a plugging device apart from the nipple.

The device 108 may be supplied with power by a battery or other power source 109. The power source 109 may be included in the plug system 104, or it may be remote therefrom. It is to be clearly understood that any means of supplying power to the device 108 may be utilized, without departing from the principles of the present invention. The power source 109 may also supply power to sensors, etc. associated with the device 108.

Figure 5B:
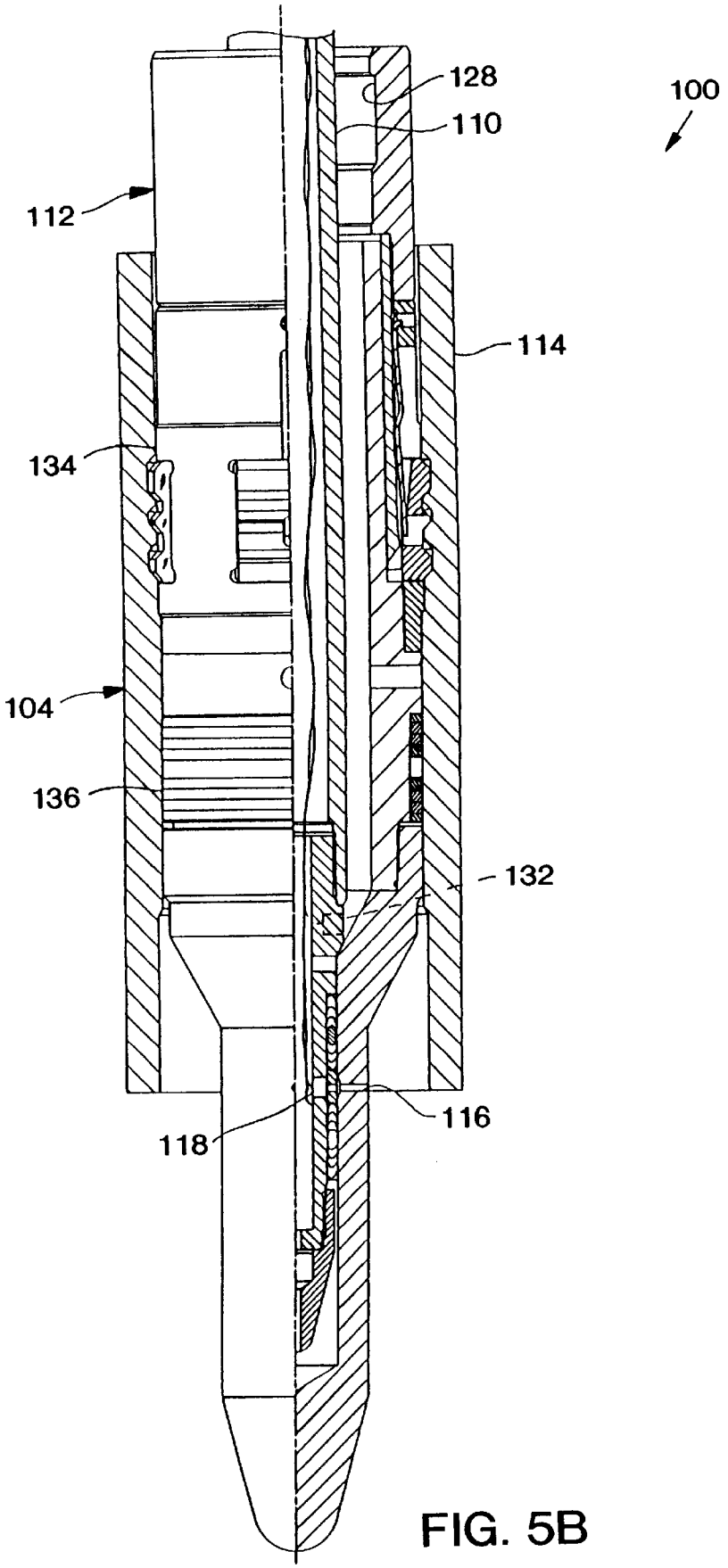

When the prong 110 is sealingly received within the plug assembly 112 as shown in FIG. 5B, fluid flow axially through the nipple 114 (and through the plug 136) is prevented. When the prong 110 is displaced upwardly relative to the plug assembly 112 and nipple 114, fluid flow is permitted through one or more relatively small openings 116 formed through a sidewall of the plug 136. Such fluid flow through the opening 116 may be used to equalize pressure across the plug assembly 112 before retrieving the plug assembly from the nipple. Note that, when the plug assembly 112 is removed from the nipple 114, relatively unrestricted fluid flow is permitted axially through the nipple.

A pressure sensor 118 is included in the prong 110 and is exposed to pressure in the nipple 114 below the plug assembly 112. Another pressure sensor 120 is included in the tool 102 and is exposed to pressure in the nipple 114 above the plug assembly 112. The pressure sensor 118 is connected to the device 108, which permits communication of pressure data from the sensor to the device 106. Pressure data from the sensor 118 (via the devices 106, 108) and pressure data from the sensor 120 may be input to an electronic circuit 122 of the tool 102 and/or transmitted to a remote location. Such pressure data may be used to determine pressures applied to the prong 110, plug assembly 112 and/or nipple 114, and may be used to determine the pressure differential across the plug assembly. The circuit 122 (or another circuit, e.g., at a remote location) may be programmed to prevent operation of the tool 102 to displace the prong 110 if the pressure differential is excessive, or to permit only limited displacement of the prong if the pressure differential is excessive. Another pressure sensor 132 may optionally be included in the prong 110 for measurement of pressure in the nipple 114 above the plug assembly 112.

The tool 102 includes one or more engagement members 124 configured for operatively engaging an external profile 126 formed on the prong 110. Such engagement permits the tool 102 to apply an upwardly directed force to the prong 110. Another portion (not shown) of the tool 102 may be engaged with another profile for releasably securing the tool relative to the nipple 114 or plug assembly 112, similar to the manner in which the tool 12 is releasably secured relative to the valve 16 using the keys 28 and profile 30 described above. For example, the tool 102 could have a portion which engages an internal profile 128 formed on the mandrel 134. In that case, the tool 102 would be releasably secured to the mandrel 134, and could be used to retrieve the mandrel by applying an upwardly directed force to the profile 128 if desired.

The engagement member 124 is displaced into engagement with the profile 126 by an actuator 130, which is connected to the circuit 122 (or to another circuit, e.g., at a remote location). The circuit 122 may be programmed or configured to permit the actuator 130 to displace the engagement member 124 into engagement with the profile 126 only when communication between the devices 106, 108 indicates that the tool 102 is operatively positioned relative to the prong 110, nipple 114 or plug assembly 112. The representatively illustrated devices 106, 108 communicate by direct electrical contact, so establishment of communication therebetween may be the indication that the tool 102 is operatively positioned.

Alternatively, the circuit 122 may be programmed to permit engagement between the engagement member 124 and the profile 126 only when the pressure differential across the prong 110 and plug assembly 112 is within an acceptable range, or at least not excessive, although, since displacement of the prong is utilized to cause reduction of the pressure differential as described above, this alternative is not preferred. As another alternative, the tool 102 may be prevented from engaging the profile 128, or may be prevented from displacing the plug assembly 112 relative to the nipple 114, if the pressure differential across the prong 110 and plug assembly is excessive.

The method 100 demonstrates that principles of the present invention may be incorporated into a variety of different apparatus and methods. Thus, the principles of the present invention are not to be considered limited to the specific apparatus and method embodiments described herein.

Figure 6:
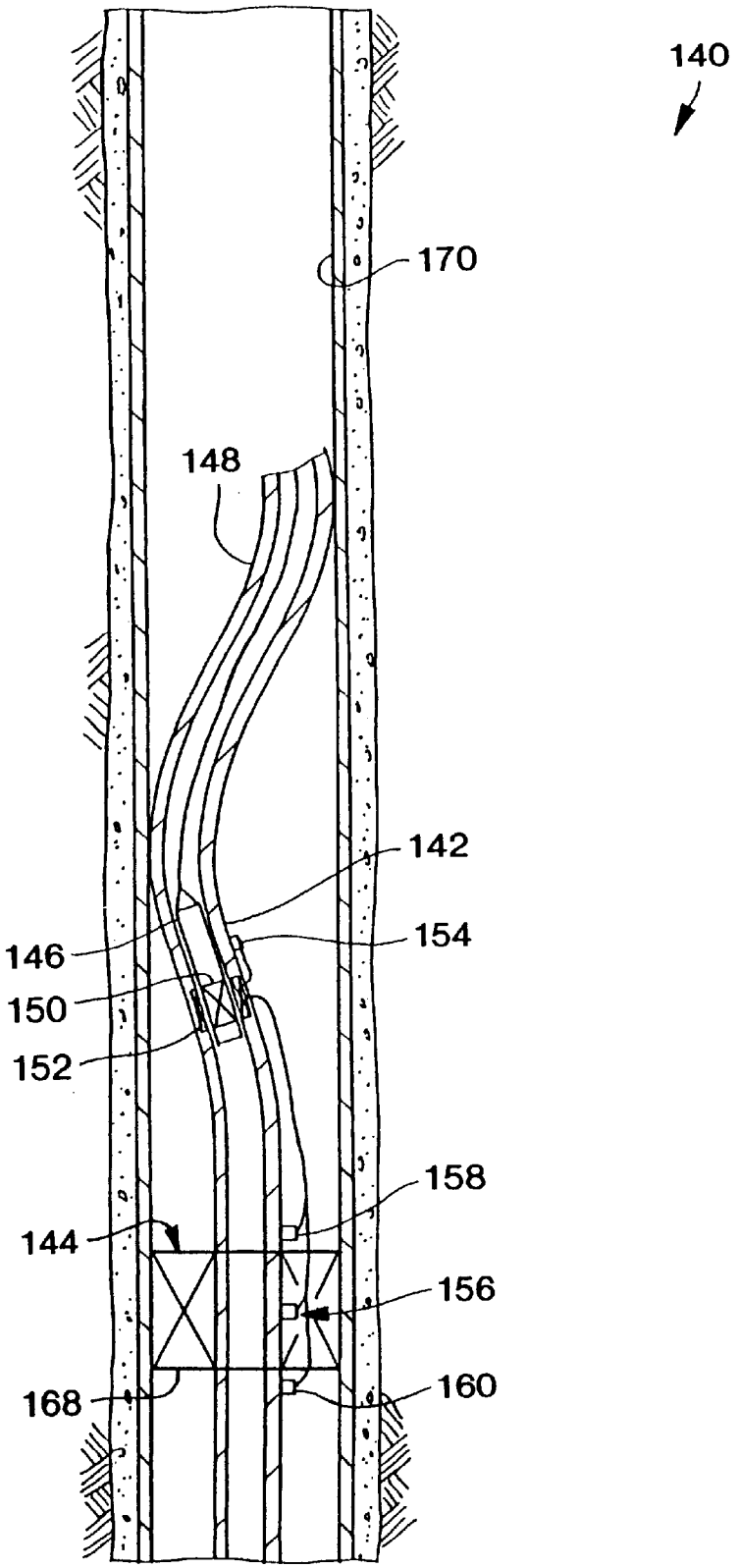
FIG. 6 is a schematic partially cross-sectional view of a sixth apparatus and method embodying principles of the present invention.

Referring additionally now to FIG. 6, another method 140 embodying principles of the present invention is representatively and schematically illustrated. In the method 140, multiple items of equipment 142, 144 are placed in communication with a service tool 146 conveyed into a tubular string 148. The item of equipment 142 is a portion of the tubular string 148, and the item of equipment 144 is a packer.

The tool 146 includes a communication device 150, and another communication device 152 is included in the string portion 142. As depicted in FIG. 6, the devices 150, 152 communicate via inductive coupling, in a manner similar to communication between the devices 58, 60 described above.

The device 152 is connected to various sensors of the string portion 142 and packer 144. For example, a sensor 154 may be positioned externally relative to the string portion 142, and a sensor 156 may be positioned internally relative to the packer 144. Additionally, other sensors 158, 160 may be positioned in the string 148 and connected to the device 152.

The sensor 154 may be a strain gauge, in which case indications of strain in the string 148 may be communicated from the device 152 to the device 150 for storage in a memory device of the tool 146 for later retrieval, e.g., at the earth's surface, or the tool 146 may transmit the indications to a remote location. Such a strain gauge sensor 154 may be utilized, for example, to identify problematic displacement of the string portion 142, which could prevent insertion of a tool string therethrough, or to monitor fatigue in the tubing string 148.

The sensor 154 may alternatively, or additionally, be a pressure sensor, temperature sensor, or any other type of sensor. For example, the sensor 154 may be utilized to indicate pressure applied to the string portion 142 or a pressure differential across the string portion. To indicate a pressure differential across the string portion 142, another of the sensors 154 may be positioned internal to the string portion.

The sensors 158, 160 may be pressure sensors, in which case indications of pressure above and below the packer 144 may be communicated via the devices 150, 152 to the tool 146 and stored therein or transmitted to a remote location. The sensors 158, 160 may be included in the packer 144, and may indicate a pressure differential across a seal member or element 168 of the packer.

Note that the device 152 is remotely located relative to the sensors 156, 158, 160 and packer 144. Thus, it will be readily appreciated that a communication device is not necessarily included in a particular item of equipment or in the same item of equipment as a source of data communicated by the device, in keeping with the principles of the present invention.

Figure 7:
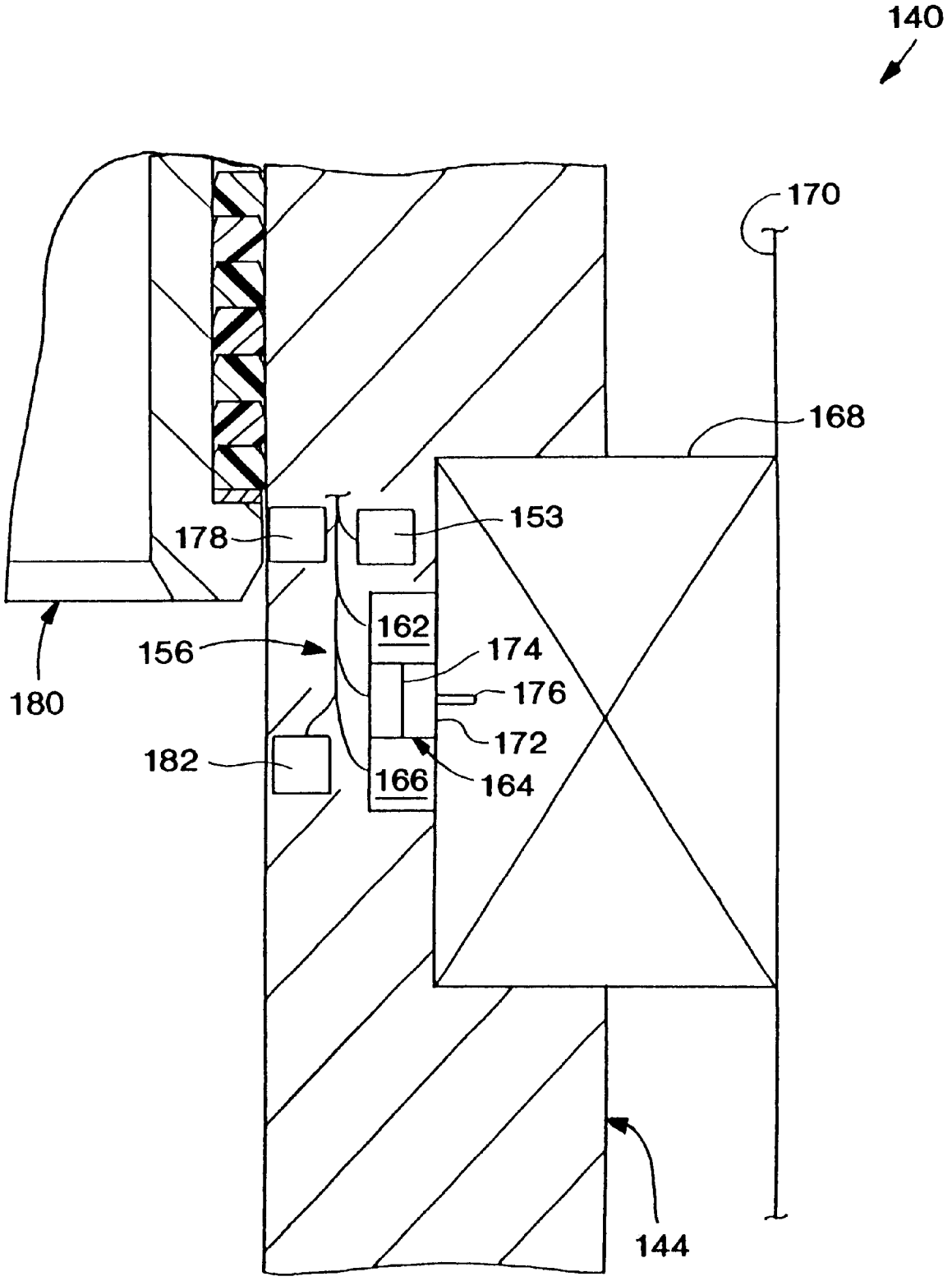
FIG. 7 is an enlarged scale schematic partially cross-sectional view of a portion of the sixth apparatus of FIG. 6.

Referring additionally now to FIG. 7, the packer 144 is shown in an enlarged quarter-sectional view. In this view, the sensor 156 is depicted as actually including multiple individual sensors 162, 164, 166. The packer 144 includes the seal member or element 168, which is radially outwardly extended into sealing engagement with a wellbore 170 of the well.

FIG. 7 also depicts a seal assembly 180 sealingly received in the packer 144. Confirmation that the seal assembly 180 is properly positioned relative to the packer 144 is provided by a position sensor 178 of the packer. The position sensor 178 is connected to the device 152, so that an indication that the seal assembly 180 is properly positioned relative to the packer 144 may be transmitted to an operator. The position sensor 178 may be a proximity sensor, a hall effect device, fiber optic device, etc., or any other sensor capable of detecting the position of the seal assembly 180 relative to the packer 144.

The sensor 162 may be a compression or pressure sensor configured for measuring compression or pressure in the seal member 168. The sensor 166 may be a temperature sensor for measuring the temperature of the seal member 168. Alternatively, one or both of the sensors 162, 166 may be a resistivity sensor, strain sensor or hardness sensor. Thus, it will be readily appreciated that any type of sensor may be included in the packer 144, without departing from the principles of the present invention.

The sensor 164 is a special type of sensor incorporating principles of the present invention. The sensor 164 includes a portion 172 configured for inducing vibration in the seal member 168, and a portion 174 configured for measuring a resonant frequency of the seal member. In operation of the sensor 164, the vibrating portion 172 is activated to cause a projection 176 extending into the seal member 168 to vibrate. For example, the vibrating portion 172 may include a piezoelectric crystal to which is applied an alternating current. The crystal vibrates in response to the current, and thereby causes the projection 176, which is attached to the crystal, to vibrate also. This vibration of the projection 176 in turn causes the seal member 168 to vibrate. Of course, the crystal could be directly contacting the seal member 168, in which case vibration of the crystal could directly cause vibration of the seal member 168, without use of the projection 176. Other methods of inducing vibration in the seal member may be utilized, without departing from the principles of the present invention.

When vibration has been induced in the seal member 168, it will be readily appreciated that the seal member will vibrate at its natural or resonant frequency. The frequency measuring portion 174 detects the resonant frequency vibration of the seal member 168, and data indicating this resonant frequency is communicated by the devices 150, 152 to the tool 146 for storage therein and/or transmission to a remote location. Note that it is not necessary for the vibrating and frequency measuring portions 172, 174 to be separate portions of the sensor 164 since, for example, a piezoelectric crystal may be used both to induce vibration in the seal element 168 and to detect vibration of the seal element.

The resonant frequency of the seal member 168 may be used, for example, to determine the hardness of the seal member and/or the projected useful life of the seal member. The strain in the tubular string 148 as detected by the sensor 154 may be used, for example, to determine a radius of curvature of the string and/or the projected useful life of the string. Thus, a wide variety of useful information regarding items of equipment installed in the well may be acquired by the tool 146 in a convenient manner.

The device 152 may be supplied with power by a battery or other power source 153. The power source 153 may be included in the packer 144, or it may be remote therefrom. It is to be clearly understood that any means of supplying power to the device 152 may be utilized, without departing from the principles of the present invention. The power source 153 may also supply power to the sensors 154, 156, 158, 160, 178 associated with the device 152. Alternatively, one or more of the sensors 154, 156, 158, 160, 178 may have a power source, such as a battery, combined therewith or integral thereto, so that a remote power source is not needed to operate the sensor. Note that any of the other sensors 50, 51, 52, 54, 118, 120, 132 described above may also include a power source. In each of the methods 10, 100, 140 described above, a power source included in any sensor used in the method may supply power to operate its associated communication device.

A memory device 182, such as a random access memory device, is shown in FIG. 7 included in the packer 144 and interconnected to the sensors 162, 164, 166. The memory device 182 is utilized to store data generated by the sensors 162, 164, 166, and then transmit the stored data to the tool 146 via the devices 150, 152. In this manner, the memory device may store, for example, indications of the hardness of, or compression in, the seal element 168 over time, and these readings may then be retrieved by the tool 146 and stored therein, or be transmitted directly to a facility at the earth's surface, for evaluation.

Note that, although the memory device 182 is shown as being included in the packer 144, it may actually be remotely positioned relative to the packer. For example, the memory device 182 could be packaged with the communication device 152. In addition, the memory device 182 may be connected to other sensors, such as the sensor 154. Power to operate the memory device 182 may be supplied by the power source 153, or another power source.

Figure 8:
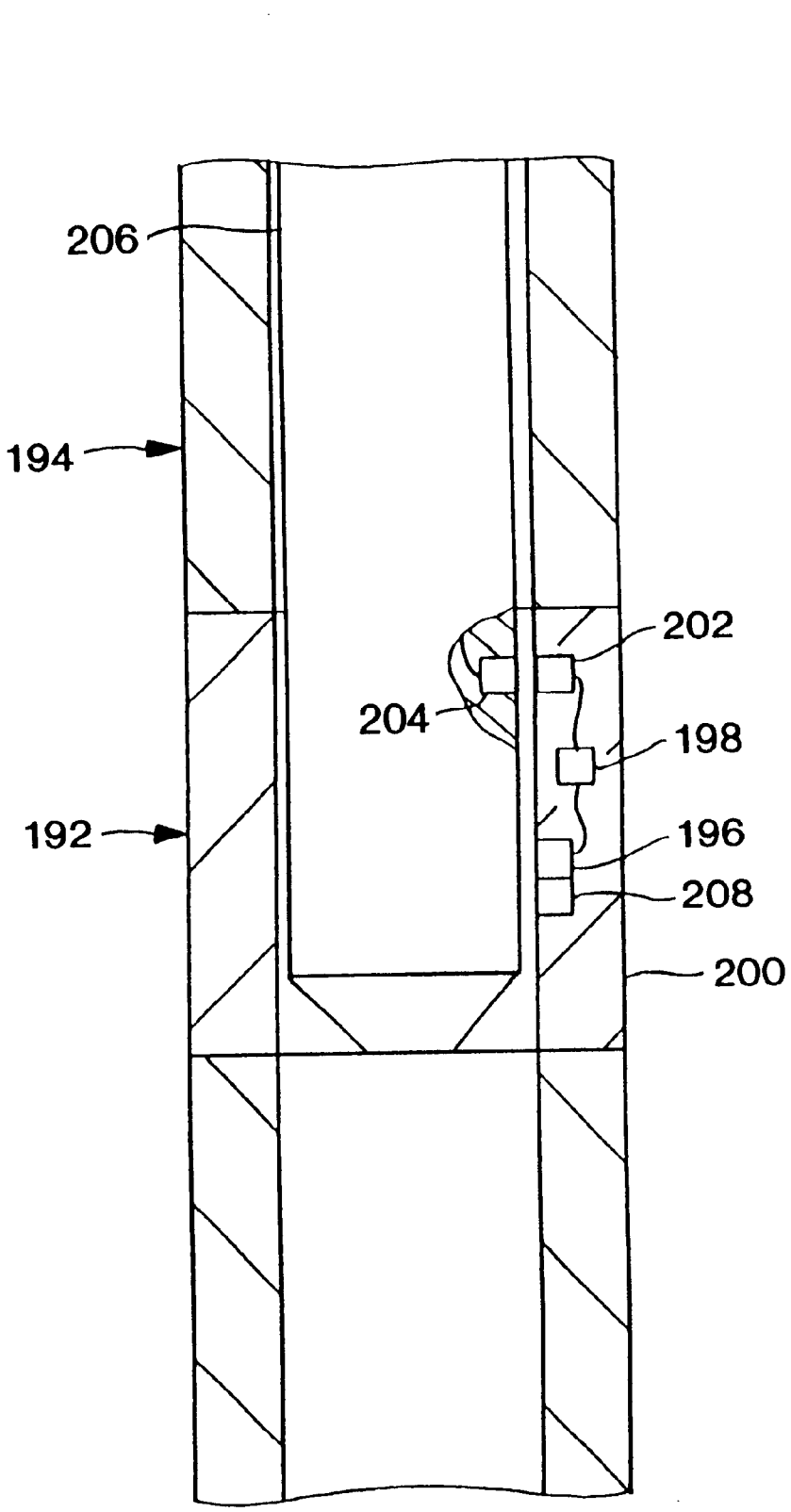
FIG. 8 is a schematic partially cross-sectional view of a seventh apparatus and method embodying principles of the present invention.

Referring additionally now to FIG. 8, another method 190 embodying principles of the present invention is schematically and representatively illustrated. In the method 190, an item of equipment 192 is interconnected in a tubular string 194. The item of equipment 192 includes a nipple 200 or other tubular housing and a particle sensor 196 of the type capable of detecting particles, such as sand grains, passing through the nipple.

A memory device 198, such as a random access memory device, is connected to the sensor 196 and stores data generated by the sensor. The sensor 196 is also connected to a communication device 202. The communication device 202 is configured for communication with another communication device 204 included in a service tool 206. The communication devices 202, 204 may be similar to any of the communication devices described above, other they may be other types of communication devices.

When the tool 206 is received in the nipple 200 and appropriately positioned relative thereto, the devices 202, 204 communicate, thereby permitting download of the data stored in the memory device 198. This data may be stored in another memory device of the tool 206 for later retrieval, or it may be communicated directly to a remote location.

Power to operate the sensor 196, the memory device 198 and/or the communication device 202 may be supplied by a power source 208, such as a battery, included with the sensor. Alternatively, the communication device 202 could be supplied with power from the communication device 204, as described above. As another alternative, the power source may not be included with the sensor, but may be remotely positioned relative thereto.

Note that it is not necessary for the data generated by the sensor 196 to be stored in the memory device 198, since data may be transmitted directly from the sensor to the tool 206 via the devices 202, 204 in real time.

It will now be fully appreciated that the method 190 permits evaluation of particle flow through the nipple 200 over time. The data for such evaluation may be conveniently obtained by conveying the tool 206 into the nipple 200 and establishing communication between the devices 202, 204. This evaluation may assist in predicting future particle production, assessing the effectiveness of a sand control program, etc.

It is to be clearly understood that, although the method 190 has been described herein as being used to evaluate particle flow axially through the tubular member 200, principles of the present invention may also be incorporated in methods wherein other types of particle flows are experienced. For example, the sensor 51 of the method 10 may be a particle sensor, in which case particle flow through a sidewall of the housing 20 may be evaluated.

The method 190 may also utilize functions performed by the communication devices as described above. For example, the communication device 202 may communicate to the communication device 204 an indication that the tool 206 is operatively positioned, or within a predetermined distance of an operative position, relative to the item of equipment 192. The communication device 204 may activate the communication device 202 from a dormant state to an active state, thereby permitting communication between the devices.

Of course, a person skilled in the art, upon a careful consideration of the above description of various embodiments of the present invention would readily appreciate that many modifications, additions, substitutions, deletions and other changes may be made to the apparatus and methods described herein, and these changes are contemplated by the principles of the present invention. For example, although certain types of sensors have been described above as being interconnected to communication devices, any type of sensor may be used in any of the above described apparatus and methods, and the communication devices described above may be used in conjunction with any type of sensor. As another example, items of equipment have been described above as being interconnected in tubing strings, but principles of the present invention may be incorporated in methods and apparatus wherein items of equipment are interconnected or installed in other types of tubular strings, such as casing or coiled tubing. Accordingly, the foregoing detailed description is to be clearly understood as being given by way of illustration and example only, the spirit and scope of the present invention being limited solely by the appended claims.

What is claimed is:

1. A particle detection system, comprising:

a tubular member interconnected in a tubular string;

a particle sensor configured for detecting flow of particles through the tubular member;

a first communication device connected to the particle sensor; and a tool received in the tubular string, the tool including a second communication device, and communication being established between the first and second devices.

2. The system according to claim 1, further comprising a memory device interconnected to the sensor.

3. The system according to claim 2, wherein the memory device stores indications of particle flow through the tubular member as detected by the sensor.

4. The system according to claim 2, wherein the memory device is connected to the first communication device.

5. The system according to claim 4, wherein data is transferred from the memory device to the tool when the first communication device communicates with the second communication device.

6. The system according to claim 1, wherein indications of particle flow through the tubular member are transferred directly from the particle sensor to the tool 206 via the first and second communication devices in real time.

7. The system according to claim 1, wherein the first and second communication devices communicate via direct electrical contact.

8. The system according to claim 1, wherein the second communication device supplies power to the first communication device, thereby permitting the first device to communicate with the second device.

9. The system according to claim 8, wherein the power is supplied by electromagnetic waves emanating from the second device.

10. The system according to claim 9, wherein the electromagnetic waves are radio frequency waves.

11. The system according to claim 8, wherein the power is supplied by pressure pulses emanating from the second device.

12. The system according to claim 11, wherein the pressure pulses are acoustic waves.

13. The system according to claim 8, wherein the power is supplied by direct electrical contact between the first and second devices.

14. The system according to claim 8, wherein the power is supplied by inductive coupling between the first and second devices.

15. The system according to claim 1, wherein the second device activates the first device from a dormant state to an active state, thereby permitting communication between the first and second devices.

16. The system according to claim 15, wherein the communication between the first and second devices is via electromagnetic waves.

17. The system according to claim 16, wherein the electromagnetic waves are radio frequency waves.

18. The system according to claim 15, wherein the communication between the first and second devices is via pressure pulses.

19. The system according to claim 18, wherein the pressure pulses are acoustic waves.

20. The system according to claim 15, wherein the communication between the first and second devices is via inductive coupling between the first and second devices.

21. The system according to claim 1, wherein the communication between the first and second devices indicates when the tool is within a predetermined distance of an operative position of the tool relative to the item of equipment.

22. The system according to claim 21, wherein the first device communicates to the second device that the tool is operatively positioned relative to the item of equipment.

23. The system according to claim 1, wherein the particle sensor detects particle flow axially through the tubular member.

24. The system according to claim 1, wherein the particle sensor detects particle flow through a sidewall of the tubular member.

* * * * *